United States Patent [19]

Keen

[11] 4,165,803

[45] Aug. 28, 1979

[54] MATERIAL GATHERING DEVICE

[75] Inventor: Ronald W. Keen, St. Peters, Mo.

[73] Assignee: National Mine Service Company, Pittsburgh, Pa.

[21] Appl. No.: 886,999

[22] Filed: Mar. 16, 1978

[51] Int. Cl.[2] ..... B65G 65/18

[52] U.S. Cl. ..... 198/515; 198/613

[58] Field of Search ..... 299/67, 68; 198/512, 198/514, 515, 518, 613, 624

[56] References Cited

U.S. PATENT DOCUMENTS

| | | | |
|---|---|---|---|
| 1,256,642 | 2/1918 | Barber . | |
| 1,528,474 | 3/1925 | French . | |
| 1,796,943 | 3/1931 | Pratt . | |
| 2,282,626 | 5/1942 | Watne | 198/515 |
| 2,595,398 | 5/1952 | Lewis . | |
| 2,612,298 | 9/1952 | Wearne . | |
| 2,693,950 | 11/1954 | Calder . | |
| 2,696,288 | 12/1954 | Ball . | |
| 2,737,284 | 3/1956 | Ball . | |
| 2,801,091 | 7/1957 | Joy . | |
| 3,352,400 | 11/1967 | Ugodin et al. . | |
| 3,390,755 | 7/1968 | Stacy . | |
| 3,817,579 | 6/1974 | Delli-Gatti, Jr. | 198/515 |
| 4,056,189 | 11/1977 | Freed, Jr. | 198/514 |

FOREIGN PATENT DOCUMENTS 117035 2/1959 U.S.S.R. .

*Primary Examiner*—Robert B. Reeves
*Assistant Examiner*—Jeffrey V. Nase
*Attorney, Agent, or Firm*—Stanley J. Price, Jr.; John M. Adams

[57] ABSTRACT

A gathering platform extends forwardly from the front end of a mixing machine and has an upper surface in which a pair of counter-rotating gathering discs are rotatably mounted. Each disc is rotated to move mined material centrally and rearwardly on the platform upper surface toward a material guide that extends rearwardly in overlying relation with a portion of each of the gathering discs to the receiving end of a longitudinally extending conveyor. A plurality of radially extending slots extend through each disc, and a material gathering arm is positioned in each slot. One end of each arm is connected to rotate with the gathering disc. The opposite end of the arm rides on a cam surface in the gathering platform. The cam surface has a first portion and a second portion. The second portion is positioned at an elevation below the first portion and beneath the material guide. Upon each revolution of the gathering discs the arms follow the cam surface to move upwardly and downwardly in the slots to extend above the upper surface of the material guide to sweep the discs and to drop below the lower surface of the material guide to pass beneath the material guide.

10 Claims, 2 Drawing Figures

MATERIAL GATHERING DEVICE

BACKGROUND OF THE INVENTION

1. Field of the Invention

This invention relates to a material gathering device for a mining machine and more particularly to a pair of counter-rotating gathering discs mounted on a gathering platform and having a plurality of arm members extending through radially positioned slots in each disc and supported to move upwardly and downwardly within the slots to permit the arms to pass beneath a material guide upon each revolution of the disc.

2. Description of the Prior Art

It is the conventional practice to utilize a material gathering device with a continuous mining machine in underground mining operations. The gathering device includes a gathering platform that extends transversely across the front of the machine and rearwardly toward the receiving end portion of an endless conveyor. The conveyor extends longitudinally along the center line of the mining machine for transporting mined material rearwardly from the gathering platform to a discharge end portion of the conveyor. A rotatable mining head, such as a driven cutter drum illustrated in U.S. Pat. Nos. 3,712,678 and 3,774,969, is rotatably mounted transversely by pivotal boom arms to the front end of the mining machine. The mining head extends forwardly of the material gathering device.

By operation of hydraulically controlled piston cylinder assemblies the boom pivots upwardly and downwardly about an axis transverse to the longitudinal axis of the mining machine. With this arrangement the mining head makes upward and downward shear cuts in the mine face. The material gathering device gathers the dislodged material as the mining machine advances forwardly, and the rotating discs feed the dislodged material rearwardly onto the receiving end portion of the conveyor. The conveyor then transports the dislodged material rearwardly to the discharge end portion for loading into a suitable haulage vehicle.

U.S. Pat. Nos. 4,056,189; 3,817,579 and 3,417,851 disclose counter-rotating discs positioned forwardly and on opposite sides of the receiving end portion of the conveyor on the gathering platform. The rotatably driven discs convey the dislodged material rearwardly from the front end portion of the gathering platform onto the receiving end of the conveyor as the mining machine advances. U.S. Pat. No. 3,417,851 utilizes wings that extend forwardly from the sidewalls of the conveyor into overlying relation with the rotatable discs. The wings include strippers that extend forwardly to the centers of the gathering discs where the end portions of the strippers are supported by bearings at the axes of rotation of the gathering discs. With this arrangement the wings and their associated strippers form a continuation of the sidewalls of the conveyor so that the mined material moved inwardly toward the center of the gathering platform by the counter-rotating discs is directed from the discs onto the receiving end of the conveyor chain.

The gathering discs of U.S. Pat. No. 2,575,287 include a plurality of equally spaced gathering arms that project radially from each disc. The arms are carried by the rotating discs and serve to directly feed the mined material collected on the gathering platform onto a conveyor extending longitudinally between the discs.

The material gathering device of U.S. Pat. No. 3,328,087 includes a pair of triple-armed feed wheels that rotate about parallel vertical axes positioned on opposite sides of the conveyor to direct the dislodged material onto the receiving end of the conveyor. U.S. Pat. Nos. 2,730,344 and 3,620,345 disclose gathering arms secured to an endless chain that are guided for orbital movement on the surface of the gathering platform or the gathering discs. The arm members are operable upon rotation of the chains to move the mined material deposited on the gathering platform onto the receiving end portion of the conveyor.

U.S. Pat. No. 3,817,579 discloses a plurality of upstanding vanes that extend in a curved path outwardly from the center to the periphery of each disc. The vanes are rotated by the disc beneath a fence that is positioned above the disc and extends from the forward end of the conveyor sidewalls to the axis of rotation of the disc. Upon rotation of the disc each vane is operable to guide the dislodged material toward the fence and to move the mined material into contact with the fence so that the material is swept centrally and rearwardly on the platform onto the receiving end of the conveyor.

Further, a problem is encountered with gathering discs of the type described above, particularly with plain discs having ribs or vanes of a relatively short vertical height in conveying wet and sloppy material and/or large pieces of mined material. The height of the ribs or vanes is limited by the clearance available between the lower surface of the material guide or fence and the upper surface of the disc for the ribs to pass beneath the lower surface of the material guide. The clearance is maintained at a minimum so that substantially all the dislodged material is moved into contact with the material guide and doesn't pass beneath the material guide. By positioning the material guide lower face as close as possible to the upper surface of the disc substantially all the mined material is swept from the disc onto the conveyor.

Therefore, there is need for a mining machine material gathering apparatus that is operable to efficiently sweep the gathering platform of mined material and particularly wet and sloppy material and/or large pieces of mined material by ribs or vanes having a vertical height operable to sweep the material toward the material guide. However, the vanes must be operable to rotate with the respective discs beneath the material guide where the guide is positioned as close as possible to the upper surfaces of the discs so that the mined material is swept from discs onto the conveyor.

SUMMARY OF THE INVENTION

In accordance with the present invention there is provided a material gathering device for a mining machine that includes a gathering platform extending forwardly from the mining machine. The gathering platform has an upper surface with a front edge portion and side edge portions extending rearwardly from the front edge portion. A plurality of gathering discs are rotatably mounted on the gathering platform adjacent the front edge portion. Each of the gathering discs has an upper surface. Drive apparatus is drivingly connected to the gathering discs for rotating the gathering discs to move mined material centrally and rearwardly on the gathering platform upper surface. A material guide is positioned in overlying relation with a portion of each of the gathering discs and extends rearwardly of the gathering discs for guiding mined material centrally and rearwardly of the gathering platform upper surface. The material guide has an upper surface and a lower surface. The material guide lower surface is positioned adjacent to the upper surfaces of the gathering discs. A plurality of slots extend through each of the gathering discs. Arm members are positioned for upward and downward movement in the respective slots. The arm members are positioned in the respective slots for rotation with the gathering discs. The arm members each have an upper edge portion arranged during a portion of each revolution of the gathering discs to move the mined material centrally and rearwardly on the gathering platform upper surface toward the material guide. Means is provided for lowering the arm members in the respective slots so that the upper edge portions of the arm members pass beneath the material guide lower surface during a portion of each revolution of the gathering discs.

The first end portion of each arm member is pivotally connected to the gathering disc to permit the arm member to pivot about a horizontal axis as the arm is raised and lowered. The means for lowering the arm members in the slots includes a cam surface formed by an annular recess positioned in underlying relation with the material guide. The cam surface is positioned at a preselected elevation below the material guide lower surface for supporting the respective arm members in a position to permit the upper edge portions of the arm members to pass unobstructed beneath the material guide upon rotation of the gathering discs.

Another cam surface of the recess extends beyond the limits of the material guide and is operable to raise the arm members in the slots to an elevation where the upper edges of the arm members extend a preselected height above the material guide upper surface. In this position the arm members are operable to sweep the mined material toward the material guide. Thus, first and second cam portions are provided to raise and lower the arm members in the slots as the discs rotate so that the arm members are raised to an operative position to sweep the gathering discs and are lowered to pass beneath the material guide upon each revolution of the discs.

Preferably, the cam surface includes an upper portion and a lower portion which is positioned at an elevation below the upper portion and underlies the material guide. Consequently, as each arm rotates with a disc it follows an upwardly and downwardly sloping arcuate path formed by the cam surface upper and lower portions. The cam surface lower portion moves the arm vertically downwardly within the slot so that the upper edge of the arm is positioned below the material guide as the arm rotates beneath the material guide. Then when the arm rotates from beneath the material guide, the arm moves from the lower cam surface back to the upper cam surface. Thus the arm is raised in the slot to its operative position on the gathering disc for sweeping the mined material centrally and rearwardly on the gathering platform toward the material guide.

Preferably, the upper and lower portions of the cam surface are connected to provide a continuous arcuate path in the gathering platform below the gathering disc. A first portion of the path is positioned at an elevation above a second portion of the path with transition regions provided between the first and second portions thereby forming upwardly and downwardly sloping arcuate portions. An end portion of each arm member is positioned on the cam surface and follows the cam surface as the disc rotates. As the arm member moves from one portion of the cam surface to the other portion, the arm moves vertically in its respective slot either to a lowered position for rotating beneath the material guide or to a raised position for sweeping the mined material on the gathering platform. This arrangement permits the material guide lower surface to be positioned closely adjacent to the upper surface of the gathering discs with the result that substantially all the mined material is swept centrally and rearwardly toward the material guide and therefrom onto the conveyor.

Accordingly, the principal object of the present invention is to provide for a mining machine, a material gathering device having a pair of counter-rotating discs with a plurality of material gathering arms arranged to move vertically within slots to lower the arms for rotation beneath a material guide upon each revolution of the gathering disc.

Another object of the present invention is to provide a material gathering device having counter-rotating discs with a plurality of radially extending arms that are operable in combination with fixed material guides to sweep dislodged material rearwardly on the gathering device to a conveyor with the arms being movable upwardly and downwardly within slots of the discs to facilitate rotation of the arms beneath the material guides.

These and other objects of the present invention will be more completely disclosed and described in the following specification, the accompanying drawings, and the appended claims.

DESCRIPTION OF THE PREFERRED EMBODIMENT

Figure 1:
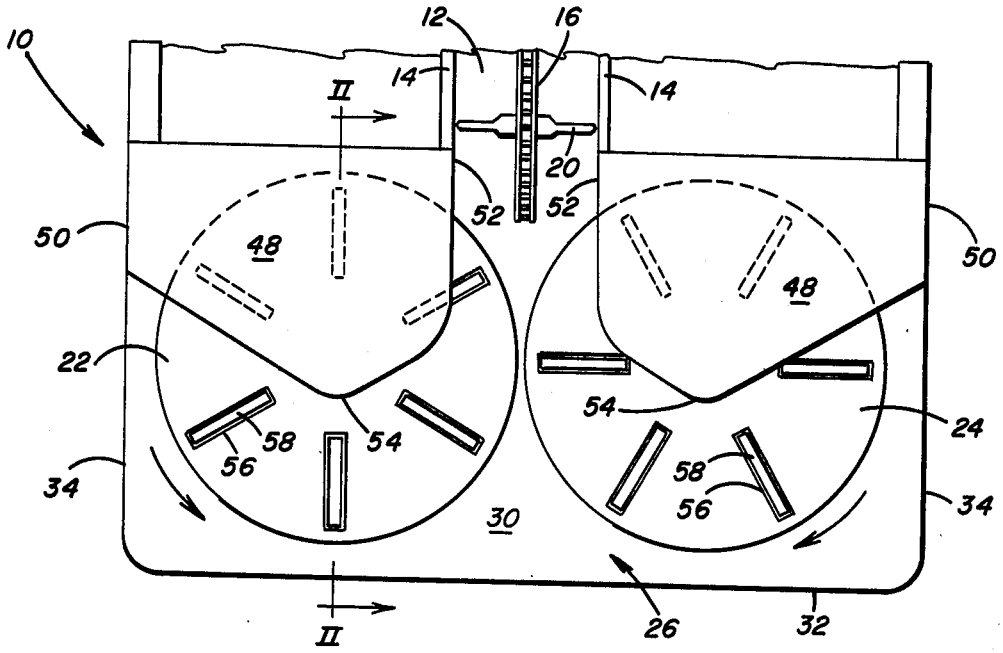
FIG. 1 is a fragmentary top plan view of a material gathering device for a mining machine, illustrating a pair of counter-rotating discs having arms arranged to move upwardly and downwardly within slots of the discs to permit the arms to rotate beneath material guides.

Referring to the drawings and particularly to FIG. 1, there is illustrated a material gathering device generally designated by the numeral 10 that is associated with a conventional mining machine that is operable to dislodge solid material from a mine face. The gathering device 10 is operable to gather the dislodged material and feed the material rearwardly onto the forward end of a conveyor 12. The gathering device 10 and the conveyor 12 are generally associated with, but are not limited to, a mining machine of the type illustrated in U.S. Pat. No. 3,774,969, which is incorporated herein by reference. The conveyor 12 has a receiving end portion extending from the rearward end portion of the gathering device 10 to a discharging end portion for conveying the mined material from the gathering device 10 rearwardly on the mining machine.

Preferably, the conveyor 12 includes a longitudinal trough having parallel spaced vertically extending sidewalls 14. An endless conveyor chain 16 is positioned in the trough and is reeved about a driven sprocket for moving the chian in the trough from the receiving end portion to the discharge end portion. The chain has a plurality of cross flights 20 for moving the mined material rearwardly in the trough.

With a mining machine of the type disclosed in the above-identified patent, the gathering device 12 is pivotally mounted on the front end portion of a self-propelled body portion. A boom (not shown) is pivotally mounted on the front of the body portion and extends in overlying relation with the gathering device 10 to support at its end portions a cutter drum member that is positioned forwardly of the gathering device. The cutter drum member includes a plurality of cutting elements which are operable upon rotation of the drum member by motors to dislodge solid materal from the mine face. The boom of the cutter drum is raised and lowered by piston cylinder assemblies to permit the cutter drum to be raised and lowered and thereby make shear cuts in the mine face. The material dislodged by the cutter drum is fed onto the gathering device 10 by the forward advancement of the mining machine.

Figure 2:
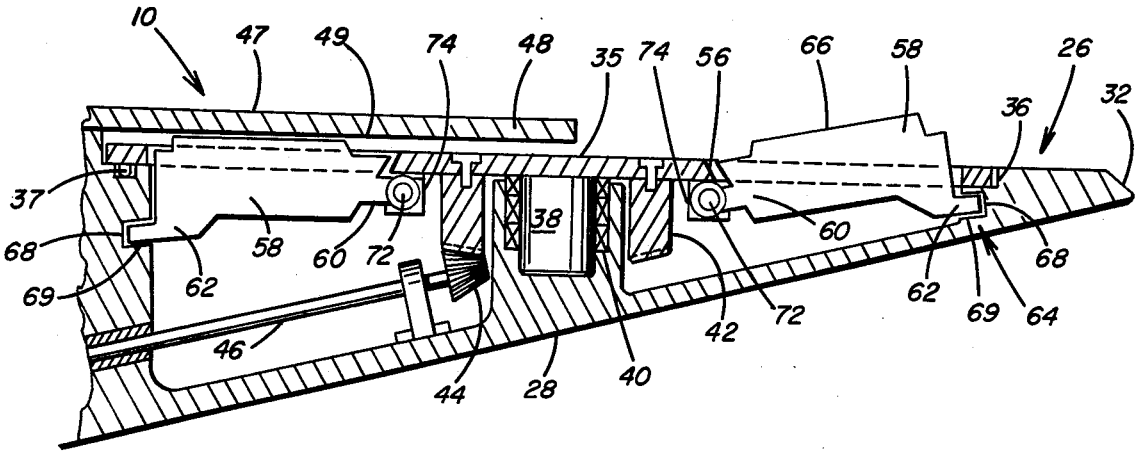
FIG. 2 is a view in side elevation taken along line 2—2 of FIG. 1, illustrating one arm of the disc in a raised position for sweeping mined material on the gathering platform and a second arm in a lowered position for rotation beneath the material guide.

The gathering device 10 includes a pair of counterrotating gathering discs 22 and 24 that are rotatably supported on a gathering platform 26. The gathering platform, as illustrated in FIG. 2, includes a ground engaging lower surface 28 that is arranged to advance on the mine floor. The gathering platform 26 has an upper surface 30 that forms with the lower surface 28 a front edge portion 32 that extends transversely across the front end of the mining machine and is positioned rearwardly and below the cutter drum member. In operation, the lower surface 28 at the front edge portion 32 slides on the mine floor so that the upper surface 30 is inclined relative to the mine floor. In FIG. 2 the gathering device 10 is shown in a raised position where the upper surface 30 would be positioned parallel with respect to the mine floor. Side edges 34 of the gathering platform extend rearwardly from the front edge portion 32 to a rearward end portion that is pivotally connected in a manner not shown to the mining machine body portion. A pair of piston cylinder assemblies in a manner well known in the art are pivotally connected at one end to the machine body portion and at the opposite end to the gathering platform 26 and are operable to raise and lower the gathering platform lower surface 28 relative to the mine floor.

As further illustrated in FIG. 2, the upper surface 30 of the gathering platform 26 includes annular recesses 36 for receiving the gathering discs 22 and 24. The upper surfaces 35 of the gathering discs and the gathering platform upper surface 30 form a continuous conveying surface for moving the mined material centrally and rearwardly toward the conveyor 12. The gathering discs are rotatably supported within the annular recesses 36, and a plurality of wear bars 37 are positioned in the recesses 36 under the discs to support the discs in the recesses.

Each gathering disc is secured by suitable means to the end of an idler shaft 38. The idler shaft 38 is rotatably supported by bearings 40 that are supported by the frame of the gathering platform. A bevel ring gear 42 is secured by suitable fastening means to each gathering disc. The bevel ring gear 42 is in meshing relation with a bevel gear 44 that is secured to the end of a power input shaft 46. The power input shaft 46 is driven by a motor (not shown) which is mounted on the gathering device 10. In the alternative power may be supplied to rotate the discs 22 and 24 by a propeller shaft (not shown) which is drivingly connected to a motor mounted on the main frame of the mining machine. The gathering discs 22 and 24 may be separately driven or drivingly connected so that one motor supplies drive to each disc. Other drive arrangements for the gathering discs may be utilized such as a conventional cone and worm drive arrangement.

With the above described drive arrangement the gathering discs 22 and 24 are rotated in the direction indicated by the arrows to move the mined material centrally and rearwardly toward the receiving end of the conveyor 12. A fixed material guide 48 extends forwardly of the receiving end of the conveyor 12 from each side of the conveyor sidewalls 14 into overlying relation with a portion of each gathering disc. Each material guide 48 has an upper surface 47 and a lower surface 49 which is positioned in spaced relation to the upper surface 35 of each disc 22 and 24. Each material guide 48 has an outer side edge 50 and an inner side edge 52, which extends forwardly from the front end of the conveyor sidewall 14. The outer and inner side edges 50 and 52 taper forwardly to form the tapered end portion 54, which is positioned in overlying relation with substantially the center of each gathering disc. The tapered end portions 54 and the oppositely spaced side edges 52 are operable to guide the mined material conveyed by the rotating discs 22 and 24 centrally and rearwardly onto the receiving end portion of conveyor 12. The conveyor 12 then transports the mined material rearwardly on the mining machine to the conveyor discharge end portion.

Each of the gathering discs 24 includes a plurality of radially extending slots 56 that extend through the respective gathering disc. Each slot 56 receives an arm member 58. Each arm member 58, as illustrated in FIG. 2, includes a first end portion 60 connected to the gathering disc for rotation with the gathering disc and a second end portion 62. The arm second end portion 62 is positioned in a guide arrangement generally designated by the numeral 64 in the body portion of the gathering platform 26 for guiding the arm member 58 along an arcuate path as it is rotated by the gathering disc in a manner to raise the arm member 58 above the material guide upper surface 47 and to lower the arm member 58 to pass beneath the material guide lower surface 49.

With this arrangement the upper edge portion 66 of each arm member 58 is lowered beneath the lower surface 49 of the material guide 48 during that portion of each revolution of the gathering disc when the arm member rotates beneath the material guide. The arm members 58 when in a raised position are operable to move the mined material, as the gathering discs rotate in the direction of the arrows, rearwardly toward the material guides. This develops a uniform flow of the material centrally and rearwardly on the gathering platform upper surface 30 into contact with the material guide edges 52 and therefrom onto the receiving end portion of the conveyor 12.

In accordance with the present invention, the material guide lower surfaces 49 are positioned closely adjacent the upper surfaces 35 of the gathering discs 22 and 24 so that the material does not become caught between the material guides and the upper surfaces of the discs and substantially all the material is directed onto the conveyor 12. Consequently, to permit the material guides to be closely positioned in overlying relation with the gathering discs, the arm members 58 are raised and lowered in the slots 56 as the discs rotate. Thus, as an arm member 58 approaches the material guide edge 52, and is positioned a preselected distance therefrom, it is lowered in the slot 56 to position the arm upper edge portion 66 below the material guide lower surface 49 as the gathering disc rotates the arm 58 beneath the material guide. When the arm rotates from beneath the material guide 48, it is raised in the slot 56 to extend the upper edge portion 66 a preselected height above the material guide upper surface 47 for the sweeping operation.

The upward and downward movement of the arm members 58 in the slots 56 is accomplished by the guide arrangement 64. The guide arrangement 64 includes a recess 68 forming a cam surface 69 that is positioned in the body of the gathering platform 26 in underlying relation with the periphery of the gathering disc. Preferably, the recess 68 is annular and follows a continuous arcuate guide path in the gathering platform 28 below each disc. The arm member second end portion 62 is positioned in the recess 68 and follows the cam surface 69 as the disc rotates the arm member.

The cam surface 69 includes a first or upper portion that is positioned at a preselected elevation below the material guide upper surface 47 and a second or lower portion which is positioned below the cam surface first portion at a preselected elevation below the material guide lower surface 49. The first portion of the cam surface 69, as viewed in a counter-clockwise direction in FIG. 1, extends from adjacent the material guide side edge 50 along a circular path away from the material guide and then back toward the material guide to adjacent the material guide side edge 52. The second portion of the cam surface 69 is positioned below the material guide lower surface 49 and extends from adjacent the side edge 52 to adjacent the side edge 50.

As illustrated in FIG. 2, the arm member 58 shown with the arm member end portion 62 positioned opposite the platform front edge 32 is retained in the first portion of cam surface 69. The arm member 58 shown with the arm member end portion 62 positioned below the material guide lower surface 49 is retained in the second portion of the cam surface 69. The transitions from one portion of the cam surface 69 to the other portion thereof form an arcuate path because the cam surface portions are at different elevations. The arm member second end portion 62 moves along this arcuate path as the disc rotates. Consequently, the arm member end portion 62 changes elevation as it moves through the transition regions of the cam surface 69, and thus the arm 58 moves upwardly and downwardly in the slot 56.

The arm member first end portion 60 is pivotally connected to the gathering disc in a manner hereinafter described so that the arm 58 rotates with the disc as the arm member end portion 62 moves in the recess 68. Consequently, the arm end portion 62 follows the arcuate path formed by the cam surface 69 to raise and lower the arm member 58 in the slot 56 upon each revolution of the disc. As the arm end portion 62 moves in the first portion of the cam surface 69, the arm member 58 is in a raised position in the slot 56 so that the arm upper edge 66 extends a preselected height above the material guide upper surface 47. Then as the arm member approaches the material guide side edge 52, the arm member second end portion 62 follows the downwardly sloping path of the cam surface 69 from the first portion to the second portion of the cam surface. The arm member is lowered within the slot 56 to permit the arm upper edge 66 to pass beneath the material guide lower surface 49. The arm member remains in this lowered position as the disc rotates the arm member below the material guide 48. When the arm member rotates from beneath the material guide side edge 50, the arm member second end portion 62 follows the upwardly sloping path of the cam surface 69 from the second portion to the first portion thereof. This raises the arm member upwardly within the slot 56. In the raised position the arm member upper edge portion 66 projects above the material guide upper surface 47 to permit the arm to sweep the material on the gathering disc.

To facilitate the upward and downward movement of the arm members 58 in the slots 56 of each gathering disc the first end portion of each arm member 58 is connected to the gathering disc for pivotal movement about a horizontal axis. To this end the arm member first end portion 60 is nonrotatably connected to one end of a pin 72 having an opposite end rotatably mounted in a pillow block 74. The pillow block 74 is securely connected to the lower surface of the gathering disc so that the pillow block 74 is carried with the gathering disc as the disc rotates.

As the second end portion 62 of the arm member 58 moves in the recess 68, as each disc rotates toward the material guide 48, the downward arcuate configuration of the recess 68 urges the arm member second end portion to move downwardly and follow the cam surface 69 of the recess 68. This permits the arm member 58 to drop vertically in the slot 56 and pass beneath the lower surface of the material guide 48. Upon rotation of each disc from beneath the material guide 48, the arm member end portion 62 is urged upwardly by the arcuate path followed by the recess 68. Thus the arm rises vertically in the slot 56 to its operative position for sweeping the disc as soon as it rotates from beneath the material guide 48.

Thus, with the present invention the material guide is positioned closely adjacent the upper surface of the disc, and consequently, substantially all the mined material on the gathering platform is conveyed toward the material guide and directed centrally and rearwardly therefrom onto the conveyor. This arrangement serves to prevent jamming of a disc and also provides a gathering arm having a sufficient vertical height to sufficiently sweep the disc of wet and sloppy material and large pieces of material.

According to the provisions of the Patent Statutes, I have explained the principle, preferred construction and mode of operation of my invention and have illustrated and described what I now consider to represent its best embodiments. However, it should be understood that, within the scope of the appended claims, the invention may be practiced otherwise than as specifically illustrated and described.

I claim:

1. A material gathering device for a mining machine comprising, a gathering platform extending forwardly from the mining machine, said gathering platform having an upper surface with a front edge portion and side edge portions extending rearwardly from said front edge portion, a plurality of gathering discs rotatably mounted on said gathering platform adjacent said front edge portion, each of said gathering discs having an upper surface, drive means drivingly connected to said gathering discs for rotating said gathering discs to move mined material centrally and rearwardly on said gathering platform upper surface, a material guide overlying a portion of each of said gathering discs and extending rearwardly of said gathering discs for guiding mined material centrally and rearwardly on said gathering platform upper surface, said material guide having an upper surface and a lower surface, said material guide lower surface being positioned adjacent to said upper surfaces of said gathering discs, a plurality of slots extending through each of said gathering discs, arm members positioned for upward and downward movement in said respective slots, said arm members being positioned in said respective slots for rotation with said gathering discs, said arm members each having an upper edge portion arranged to extend to an elevation above said material guide upper surface during a portion of each revolution of said gathering discs to move the mined material centrally and rearwardly on said gathering platform upper surface toward said material guide, and means for lowering said arm members in said respective slots so that said upper edge portions of said arm members pass beneath said material guide lower surface during a portion of each revolution of said gathering discs.

2. A material gathering device for a mining machine as set forth in claim 1 which includes, means for raising said arm members in said respective slots after said arm members are lowered in said slots so that said arm members extend to an elevation above said material guide upper surface as said arm members rotate with said gathering discs from underlying relation with said material guide.

3. A material gathering device for a mining machine as set forth in claim 1 in which said means for lowering said arm members includes, a cam surface positioned in underlying relation with said material guide, and said cam surface positioned at a preselected elevation below said material guide lower surface for supporting said respective arm members in a position to permit said upper edge portions of said arm members to pass unobstructed beneath said material guide upon rotation of said gathering discs.

4. A material gathering device for a mining machine as set forth in claim 1 which includes, a cam surface positioned in underlying relation with a portion of each of said gathering discs, said cam surface positioned at a preselected elevation below said gathering platform upper surface for supporting said respective arm members in a position to raise said upper edge portions of said respective arm members in said slots to a preselected height above said gathering platform upper surface, and said arm members in said raised position being operable to sweep the mined material centrally and rearwardly on said gathering platform upper surface toward said material guide.

5. A material gathering device for a mining machine as set forth in claim 1 which includes, a pair of cam surfaces positioned in underlying relation with said respective gathering discs, a first cam surface of said pair arranged to support said respective arm members in a raised position in said slots to extend to an elevation above said material guide upper surface, said arm members in said raised position being operable to sweep the mined material centrally and rearwardly on said upper surface of said gathering platform toward said material guide upon rotation of said gathering discs, a second cam surface of said pair positioned at an elevation below said first cam surface and in underlying relation with said material guide, said second cam surface arranged to support said respective arm members in a lowered position so that said upper edge portions thereof pass beneath said material guide lower surface as said respective gathering discs rotate beneath said material guide, and said arm members being operable to ride on said pair of cam surfaces to move upwardly and downwardly in said respective slots upon each revolution of said respective gathering discs.

6. A material gathering device for a mining machine as set forth in claim 1 which includes, pivotal means for connecting said arm members to said respective gathering discs to permit said arm members to pivot about a horizontal axis, and said arm members being arranged to pivot downwardly about said horizontal axis as said arm members pass beneath said material guide to permit said upper edge portions of said arm members to move to an elevation below said material guide lower surface.

7. A material gathering device for a mining machine as set forth in claim 1 which includes, a cam surface positioned in said gathering platform below said gathering discs, said cam surface having a first portion positioned at a preselected elevation below said gathering platform upper surface, said cam surface having a second portion positioned below said first portion and at a preselected elevation below said material guide lower surface, and said arm members being operable to move on said cam surface first and second portions upon rotation of said respective gathering discs to move upwardly and downwardly within said slots between a raised position above said material guide upper surface and a lowered position below said material guide lower surface.

8. A material gathering device for a mining machine as set forth in claim 7 which includes, said material guide having laterally spaced edge portions extending in overlying relation with a portion of said respective gathering discs, said cam surface first portion extending below said gathering platform upper surface beyond the limits of said material guide edge portions, said cam surface first portion arranged to move said arm members in said slots to said raised position above said material guide upper surface for sweeping said gathering discs, and said cam surface second portion extending below said gathering platform upper surface in underlying relation with said material guide and arranged to move said arm members in said slots to said lowered position beneath said material guide lower surface.

9. A material gathering device for a mining machine as set forth in claim 1 which includes, conveyor means extending rearwardly of said gathering platform on the mining machine for conveying mined material rearwardly from said gathering platform, said conveyor means having a receiving end portion centered rearwardly of said gathering discs, said material guide extending laterally from each side of said conveyor means receiving end portion into overlying relation with said gathering discs, said material guide being operable to direct mined material rearwardly onto said conveyor means receiving end portion, and said arm members being arranged upon rotation of said gathering discs to move upwardly within said slots to a raised position above said material guide upper surface to sweep the mined material toward said material guide and to move downwardly within said slots to a lowered position to pass beneath said material guide lower surface.

10. A material gathering device for a mining machine as set forth in claim 1 which includes, a pin connected to each of said gathering discs below said gathering platform upper surface for rotation with said respective gathering discs, said pin being supported for rotation about a horizontal axis, and said arm members each having a first end portion nonrotatably connected to said pin to permit said arm members to move upwardly and downwardly within said slots upon rotation of said gathering discs.

* * * * *